United States Patent [19]

White

[11] Patent Number: 4,700,183

[45] Date of Patent: Oct. 13, 1987

[54] FORMAT FOR IMPROVING THE READABILITY OF NUMERIC DISPLAYS

[75] Inventor: Rogers P. White, Yonkers, N.Y.

[73] Assignee: North American Philips Corporation, New York, N.Y.

[21] Appl. No.: 278,145

[22] Filed: Jun. 29, 1981

[51] Int. Cl.[4] ..... G09G 3/04

[52] U.S. Cl. ..... 340/756; 340/763; 340/762; 340/787

[58] Field of Search ..... 340/756–765, 340/803, 804, 815.03, 815.04, 815.05, 323 R, 787

[56] References Cited

U.S. PATENT DOCUMENTS

| | | | |
|---|---|---|---|
| 2,992,364 | 7/1961 | Rasmussen | 340/756 |
| 3,146,436 | 8/1964 | Crow | 340/758 |
| 3,320,585 | 5/1967 | Hines | 340/756 |
| 3,444,319 | 5/1969 | Artzt et al. | 340/756 |
| 3,541,543 | 11/1970 | Crawford et al. | 340/756 |
| 3,981,002 | 9/1976 | Gardner | 340/323 R |

*Primary Examiner*—Marshall M. Curtis
*Attorney, Agent, or Firm*—Paul R. Miller

[57] ABSTRACT

A new format for numerical displays is provided wherein open portions or notches occurring in the ordinary display are closed. By such arrangement, the present invention enables a complete arrangement of numbers ranging in value from 0 to 9 to all have the same height and width. Such numbers are especially useful in electrophoretic or liquid crystal displays, as well as active displays using light emitting diodes.

8 Claims, 7 Drawing Figures

FORMAT FOR IMPROVING THE READABILITY OF NUMERIC DISPLAYS

The present invention is directed to a new arrangement for providing numerical characters in a numeric display.

Numeric displays which are presently available normally involve a seven-segment arrangement. Such structures suffer from cosmetic defects in the layout of the numeric character which produces an unpleasant or unpleasing numeric character. These defects include notches in portions of the segments producing the numbers 1, 7, and 0 as well as shortening of one leg of numbers, such as the number 4. In addition, portions of the numbers 2, 5, and 6 are shortened. In a row of numeric information such defects in numeric displays can cause the numbers to appear to have different heights and widths causing a very uneven appearance.

An example of prior known seven-segment displays may be seen in the Morokawa et al patent, U.S. Pat. No. 3,971,017. The numbers and letters typically produced by this type of display suffer from breaks or notches in the numbers or letters, as well as shortening and unevenness in the heights and widths of the various numerals and letters.

In passive displays, such an electrophoretic devices, liquid crystal devices or electrochromic devices, additional segments can be added to the numeric format at no additional costs to the display itself. It is only a matter of changing the mask used in etching the electrodes. The present invention involves forming numeric displays that are complete and pleasing without notching or variations in heights and/or widths.

Accordingly, the present invention is directed to numeric displays having complete or filled-in portions of the number portions.

In particular, the present invention utilizes additional segments in the numeric format which fill in previously existing notches and shortened portions. For example, by the addition of only five more segments, complete filling in of numerical formats may be obtained without any notching or shortening of the numeral.

While this additional number of segments increases the number of input leads to the display, the number of increased leads need only be three, instead of five even though five segments are added to the format. That is, although five additional segments are provided in the numeric format, only ten input leads are required for the new twelve segment display.

Such a format can be provided by way of a drive circuit in which certain of the additional segments are connected by way of OR gates to input leads of the original seven input leads of a numeric display. Two additional input leads can thus be provided. The remaining three segments of the numeric display can be all fed with a single input lead.

The format produced by the present invention results in a complete numeral without notches or shortening of the numeric segments, as occur in the presently available displays. This new numeric format display is especially useful in passive display devices, such as the electrophoretic or EPID devices. In addition, however, this format is extremely useful in active displays utilizing light emitting diodes, for example.

Features of the present invention may be seen in further detail by reference to the accompanying drawing figures which show without limitation the following features:

FIG. 5 is a partial example of a passive type electrophoretic display used in the present invention; and FIG. 6 is a partial example of an active type light emitting diode display used in the present invention.

Figure 1A:
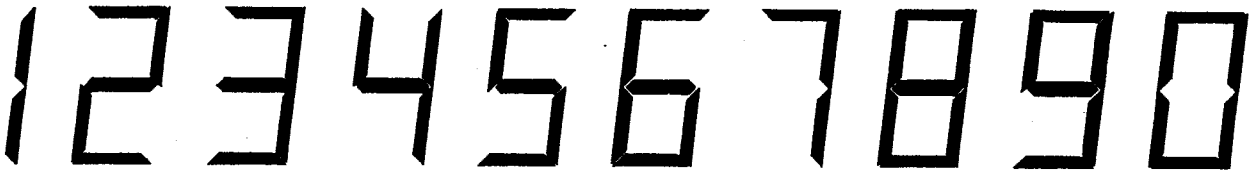
Fig. 1A PRIOR ART
FIGS. 1A and 1B are examples of prior art numeric displays wherein notches and shortening of the numbers occur.
Figure 1B:
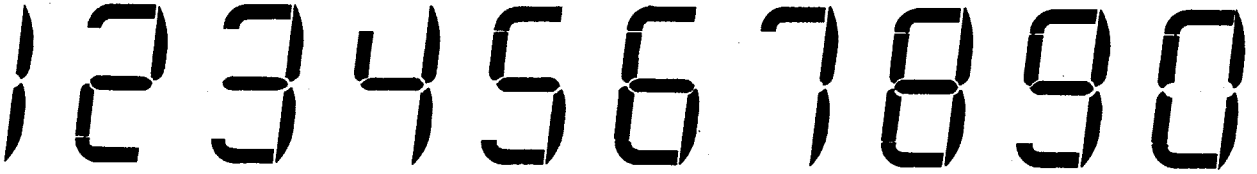
Fig. 1B PRIOR ART

The problem with the presently occurring seven segment numeric display may be seen by reference to FIGS. 1A and 1B. In this regard, as is noted, the numbers are notched between portions, such as seen in the numbers 1, 7 and 0. In addition, the legs of numbers, such as the number 4 and portions of the numbers 2, 5 and 6 are shortened or cut off. By reference to these drawing figures, the prior art arrangements cause most of the numbers to have different heights and widths, thereby causing a very uneven appearance.

Figure 2:
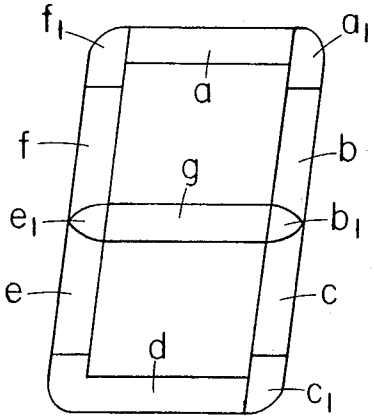
FIG. 2 is a schematic illustration of the portions of the numeric format according to the present invention.

The present invention, on the other hand, utilizes a new format for the numbers which include additional segments. As may be seen in FIG. 2, the segments $a_1$, $b_1$, $c_1$, $e_1$, and $f_1$, are utilized with the ordinary seven-segment numeric portions a, b, c, d, e, f, and g. The additional segments fill-in or block notches or incomplete portions of the numbers.

In this arrangement, when displaying the numbers zero through nine, the segments $a_1$, $b_1$ and $c_1$, may be on at all times. Because of this continuous display, these segments may be electrically connected together. The joining of these segments thereby result in a decrease in the number of input leads to the display to only three, even though a new twelve segment display is provided.

The segment $e_1$ need only turn on when the segments e or f are on. Further, the segments $f_1$ need only turn on when the segments a or f are on.

Figure 3:
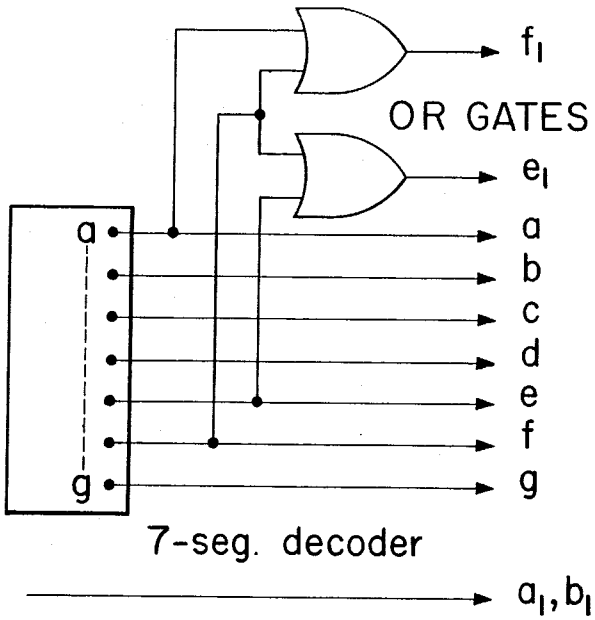
FIG. 3 is a schematic illustration of a driving arrangement providing the twelve segment display of the present invention.

An example of a driving circuit for such an arrangement may be seen in FIG. 3 wherein the segments $e_1$ and $f_1$ are connected through OR gates to the outputs of leads to the a, e or f segments in a seven-segment decoder-driver circuit. In this structure, the segment $e_1$ turns on only when the segments e or f are turned on, while the segment $f_1$ turns on only when the segments a or f are turned on in the seven-segment decoder. The remaining segments $a_1$, $b_1$, and $c_1$ are all connected through a single line in order to maintain these portions or segments on at all times.

Figure 4:
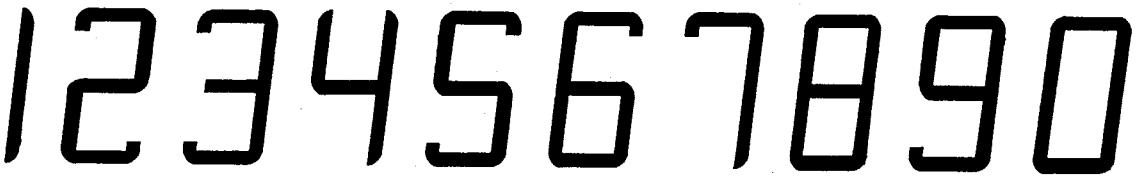
FIG. 4 are examples of numbers formed by the present invention.

Numerals using this format are illustrated in FIG. 4. It is clearly seen there are no notches or shortening of segments in the numerical elements.

FIG. 5 shows an example of an electrophoretic type of passive display in which the numeric display of the present invention can be used. FIG. 6 shows an example of a light emitting diode type of active display in which the numeric display of the present invention can be used.

What I claim is:

1. A numeric display comprising twelve segments contiguously connected in the form of a continuous number eight, and means for electrically energizing each of the twelve segments selectively in accordance with numerals ranging from 0 to 9.

2. A numeric display according to claim 1, wherein said energizing means include a circuit element combined with OR gates to produce nine outputs respectively connected to nine of said twelve segments.

3. A numeric display according to claim 2, wherein three further outputs are combined into a single line feeding three of said segments with the same value.

4. A numeric display according to claim 1, wherein said energizing means provides ten input leads to each numeral.

5. A numeric display according to claim 1, wherein said display is a passive display.

6. A numeric display according to claim 5, wherein passive display is an electrophoretic display.

7. A numeric display according to claim 1, wherein said display is an active display.

8. A numeric display according to claim 7, wherein said active display is a light emitting diode display.

* * * * *